US010743633B2

(12) United States Patent
Cooper et al.

(10) Patent No.: US 10,743,633 B2
(45) Date of Patent: Aug. 18, 2020

(54) DUAL FUNCTION HAIR STYLING TOOL HOLDER

(71) Applicant: Polder Products, LLC, Oxford, CT (US)

(72) Inventors: Kerry Cooper, Pleasantville, NY (US); Luke Johnson, Huntington, CT (US)

(73) Assignee: Polder Products, LLC, Oxford, CT (US)

( * ) Notice: Subject to any disclaimer, the term of this patent is extended or adjusted under 35 U.S.C. 154(b) by 0 days.

(21) Appl. No.: 15/921,848

(22) Filed: Mar. 15, 2018

(65) Prior Publication Data

US 2018/0263349 A1 Sep. 20, 2018

Related U.S. Application Data

(60) Provisional application No. 62/472,893, filed on Mar. 17, 2017.

(51) Int. Cl.
*A45D 1/00* (2006.01)
*A45C 11/00* (2006.01)

(52) U.S. Cl.
CPC ..... *A45D 1/00* (2013.01); *A45C 11/00* (2013.01); *A45C 2200/00* (2013.01); *A45D 2001/002* (2013.01); *A45D 2200/05* (2013.01)

(58) Field of Classification Search
CPC ..... A45D 1/00; A45D 2001/002; A45D 2200/05; A45D 2200/152; A45C 11/00; B65D 85/00; B65D 85/20; B65D 43/16; B65D 43/164; B65D 43/26; B65D 25/107; B65D 2583/00; B65D 2585/00
USPC ..... 206/349, 361, 15.3, 581, 320; 220/826, 220/682, 836; D3/205; D28/38, 73
See application file for complete search history.

(56) References Cited

U.S. PATENT DOCUMENTS 2,558,124 A * 6/1951 Burden ..... A01K 97/06 220/520
2,798,784 A * 7/1957 Marshall ..... A47J 47/14 312/199
2,955,705 A * 10/1960 Krueger, Sr. ..... A61B 50/30 206/365

(Continued)

OTHER PUBLICATIONS 2-in-1 Hot Sleeve, Polder, published at polder.com, date and author not listed © 2018 Polder Products, LLC, online, site visited Feb. 9, 2018. Available from Internet, URL: https://www.polder.com/personal-care/2-in-1-hot-sleeve-grey (Year: 2018).

*Primary Examiner* — Chun Hoi Cheung
*Assistant Examiner* — Brijesh V. Patel
(74) *Attorney, Agent, or Firm* — Duane Morris LLP

(57) ABSTRACT

A tool holder includes a body including a first half and a second half. The first half and the second half define an opening at a proximal end and an appliance cavity therebetween. A rotation element couples the first half of the body to the second half of the body. The first half and the second half are rotatable about an axis of rotation defined by the rotation element from a first configuration to a second configuration. In the first configuration the first half and the second half are in a facing relationship and define a cavity therebetween. In the second configuration the first half and the second half are in an end-to-end relationship and aligned on a longitudinal axis.

20 Claims, 13 Drawing Sheets

(56) References Cited

U.S. PATENT DOCUMENTS 3,426,890 A * 2/1969 Bayer ..... B65D 43/164 206/379
3,429,424 A * 2/1969 Dow ..... B65D 25/103 206/327
3,549,055 A * 12/1970 Gatland ..... A61M 15/009 222/182
D233,196 S 10/1974 Fry
D236,175 S 8/1975 Wintz
D242,953 S 1/1977 Bluestein
D244,722 S 6/1977 Bluestein
D244,724 S 6/1977 Bluestein
D261,317 S 10/1981 Oberheim et al.
D261,319 S 10/1981 Oberheim
4,294,299 A * 10/1981 Dorsen ..... A45C 13/06 150/123
4,308,878 A * 1/1982 Silva ..... A45D 1/00 132/232
4,417,613 A * 11/1983 Ryan ..... A61J 17/008 206/438
4,446,972 A 5/1984 Sussman
D287,203 S 12/1986 Jenkins et al.
4,628,705 A * 12/1986 Nave ..... F25D 3/08 62/371
4,671,408 A * 6/1987 Raines ..... A61M 5/002 206/1.5
D300,065 S * 2/1989 Zaborowski ..... A61M 5/002 D28/18
D313,089 S 12/1990 Schuler
D315,269 S 3/1991 Brazis
5,078,267 A * 1/1992 Wright ..... A61M 5/002 206/364
5,114,006 A * 5/1992 Wilk ..... B65D 81/36 206/349
5,141,189 A 8/1992 Andrew
D329,304 S 9/1992 Tipp
5,203,456 A 4/1993 Boswell
D348,542 S 7/1994 Cannella
D350,230 S 9/1994 O'Brien
5,474,179 A * 12/1995 Iosif ..... A61F 5/451 206/363
D371,220 S 6/1996 Behrens
D374,312 S 10/1996 Edgar
5,562,209 A 10/1996 Jackson et al.
5,577,607 A 11/1996 Drake et al.
D385,705 S 11/1997 Seifert
5,743,415 A 4/1998 Smart
5,842,567 A * 12/1998 Rowe ..... A61B 50/3001 206/364
5,924,566 A 7/1999 Gibbs
6,012,580 A * 1/2000 Peters ..... B65D 75/58 206/438
6,068,122 A 5/2000 Burns et al.
6,162,476 A * 12/2000 Shorin ..... A23G 3/563 220/4.23
6,510,965 B1 * 1/2003 Decottignies ..... B05B 11/00412 222/95
6,527,245 B2 * 3/2003 Graves ..... E01F 9/615 102/343
6,574,985 B2 * 6/2003 Fiore, Jr. ..... A45F 3/18 62/457.4
6,675,959 B1 * 1/2004 Chiang ..... A45C 11/04 206/6
6,703,587 B2 3/2004 Sena et al.
6,808,066 B2 10/2004 Bean
6,820,755 B1 11/2004 Ranjit
D508,146 S 8/2005 LeBlanc
D540,981 S 4/2007 Rosdal
7,337,902 B2 3/2008 Rosdal
D584,856 S 1/2009 Kirschenmann
D584,857 S 1/2009 Kirschenmann
7,597,196 B2 * 10/2009 Langone ..... A61M 5/002 206/364
D608,054 S 1/2010 Radfar
D655,545 S 3/2012 Bowler
D663,943 S * 7/2012 Walsh ..... A61J 17/008 D3/203.1
D670,865 S 11/2012 Cooper et al.
D676,697 S 2/2013 Chopdat
8,430,241 B1 4/2013 Balogh
D682,469 S 5/2013 Balogh
8,517,173 B2 * 8/2013 Gui ..... B65D 11/18 206/349
D690,131 S 9/2013 Clough
D700,836 S * 3/2014 Lai ..... A45C 13/06 D9/415
8,714,407 B2 * 5/2014 Frank ..... B65D 35/28 222/103
D711,043 S 8/2014 Cooper
8,915,393 B2 * 12/2014 Hayton ..... B65D 50/04 220/326
8,960,428 B2 2/2015 Hasegawa
D725,342 S * 3/2015 Desposito ..... A47J 47/14 D1/122
9,027,749 B2 5/2015 Hill
D732,291 S 6/2015 Hsieh
9,333,289 B1 * 5/2016 Hirschmann ..... A61M 5/002
D830,631 S 10/2018 Cooper et al.
2005/0161353 A1 7/2005 Devine
2007/0017837 A1 1/2007 McCambridge
2007/0095690 A1 * 5/2007 Nguy ..... B25H 3/006 206/372
2008/0083304 A1 * 4/2008 Finn ..... B25B 13/461 81/177.4
2009/0065661 A1 3/2009 Burk
2009/0145090 A1 * 6/2009 Vassigh ..... B65D 75/22 53/456
2010/0224651 A1 * 9/2010 Zlatic ..... A47K 5/122 222/182
2013/0075301 A1 3/2013 McLaughlin
2015/0083755 A1 * 3/2015 Mecker ..... A61L 9/14 222/183
2015/0164743 A1 * 6/2015 Janson ..... A61M 5/008 206/571
2015/0203248 A1 * 7/2015 Fellin ..... A47G 23/00 220/737
2016/0037886 A1 * 2/2016 Edwards ..... A45C 11/20 206/545

* cited by examiner

DUAL FUNCTION HAIR STYLING TOOL HOLDER

CROSS-REFERENCE TO RELATED APPLICATION

This application claims benefit of U.S. Provisional Application 62/472,893, filed on Mar. 17, 2017, entitled "DUAL FUNCTION HAIR STYLING TOOL HOLDER," which is incorporated by reference herein in its entirety. This application further incorporates by reference U.S. Design application No. 29/582,835, filed on Oct. 31, 2016, entitled "DUAL FUNCTION HAIR STYLING TOOL HOLDER."

FIELD OF DISCLOSURE

The disclosed apparatus and method are directed to home accessories. More particularly, the disclosed apparatus and method are directed to home accessories for holding and storing heated appliances.

SUMMARY

In various embodiments, a tool holder is disclosed. The tool holder includes a body including a first half and a second half. The first half and the second half define an opening at a proximal end and an appliance cavity therebetween. A rotation element couples the first half of the body to the second half of the body. The first half and the second half are rotatable about an axis of rotation defined by the rotation element from a first configuration to a second configuration. In the first configuration the first half and the second half are in a facing relationship and define a cavity therebetween. In the second configuration the first half and the second half are in an end-to-end relationship and aligned on a longitudinal axis.

In various embodiments, a heatable tool holder is disclosed. The heatable tool holder includes a body having a first half and a second half each extending from a proximal end to a distal end. The first half is rotatably coupled to the second half at the proximal end. The body is configured to be transitioned from a first configuration having the first half and the second half in a facing relationship defining a cavity therebetween and an opening extending through the proximal end to the cavity to a second configuration having the first half and the second half in an end-to-end relationship and aligned on a longitudinal axis. A plurality of spines extend from an inner surface of the body at least partially into the cavity. The spines are sized and configured to support a portion of a heatable tool inserted into the cavity in a spaced relationship with the inner surface of the body.

In various embodiments, a method of supporting and storing a heatable tool is disclosed. The method includes positioning a heatable tool holder in a first position. The heatable tool holder includes a body having a first half rotatably coupled to a second half. In the first position the first half and the second half of the body are in an end-to-end relationship and aligned on a longitudinal axis. A heatable tool is positioned on the first half of the body. The heatable tool holder is transitioned from the first position to a second position. In the second position the first half and the second half are in a facing relationship and define an appliance cavity therebetween. The heatable tool is positioned within the appliance cavity.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
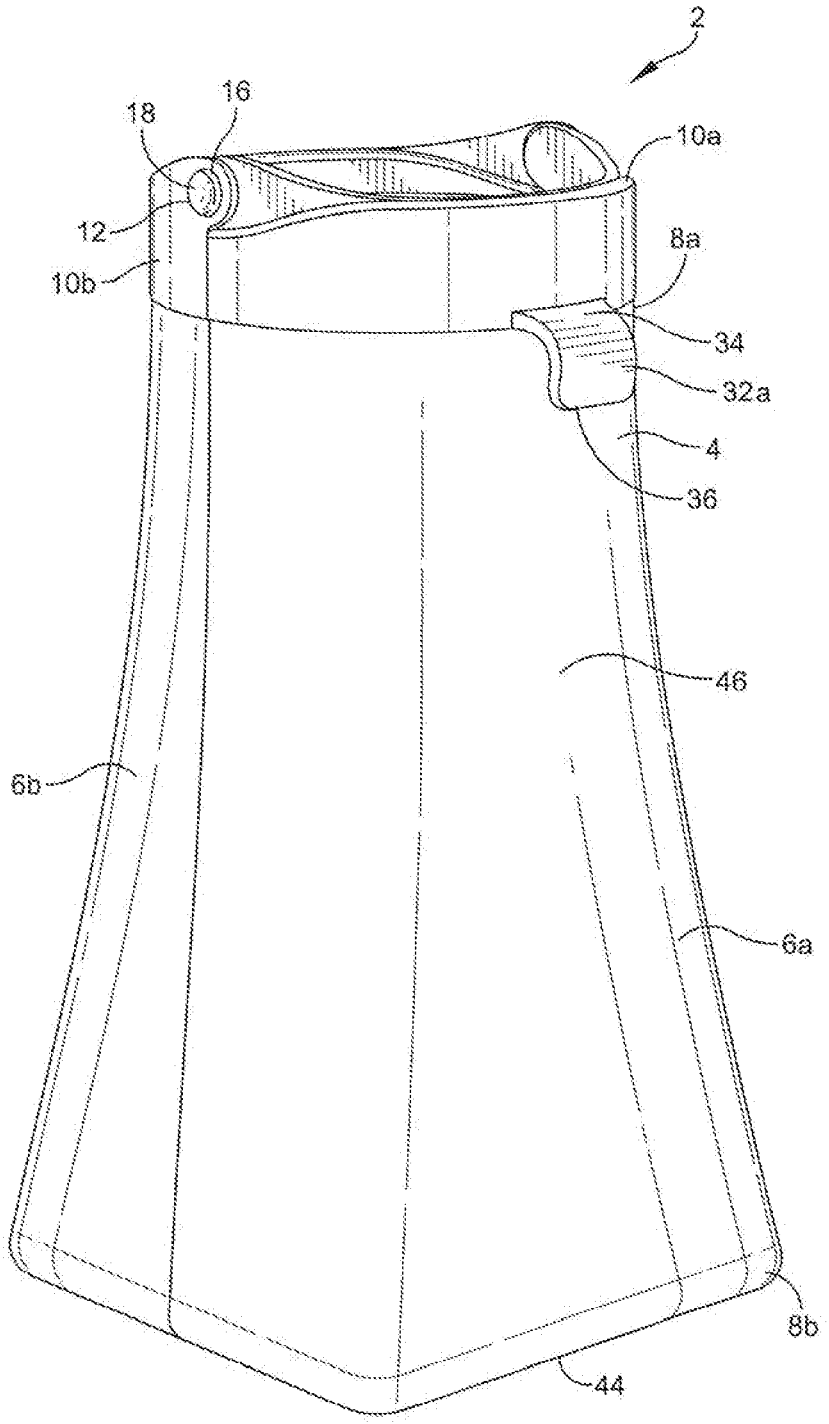
FIG. 1 is an isometric view of a tool holder configured to support and store a heatable tool in a closed position, in accordance with some embodiments.
Figure 2:
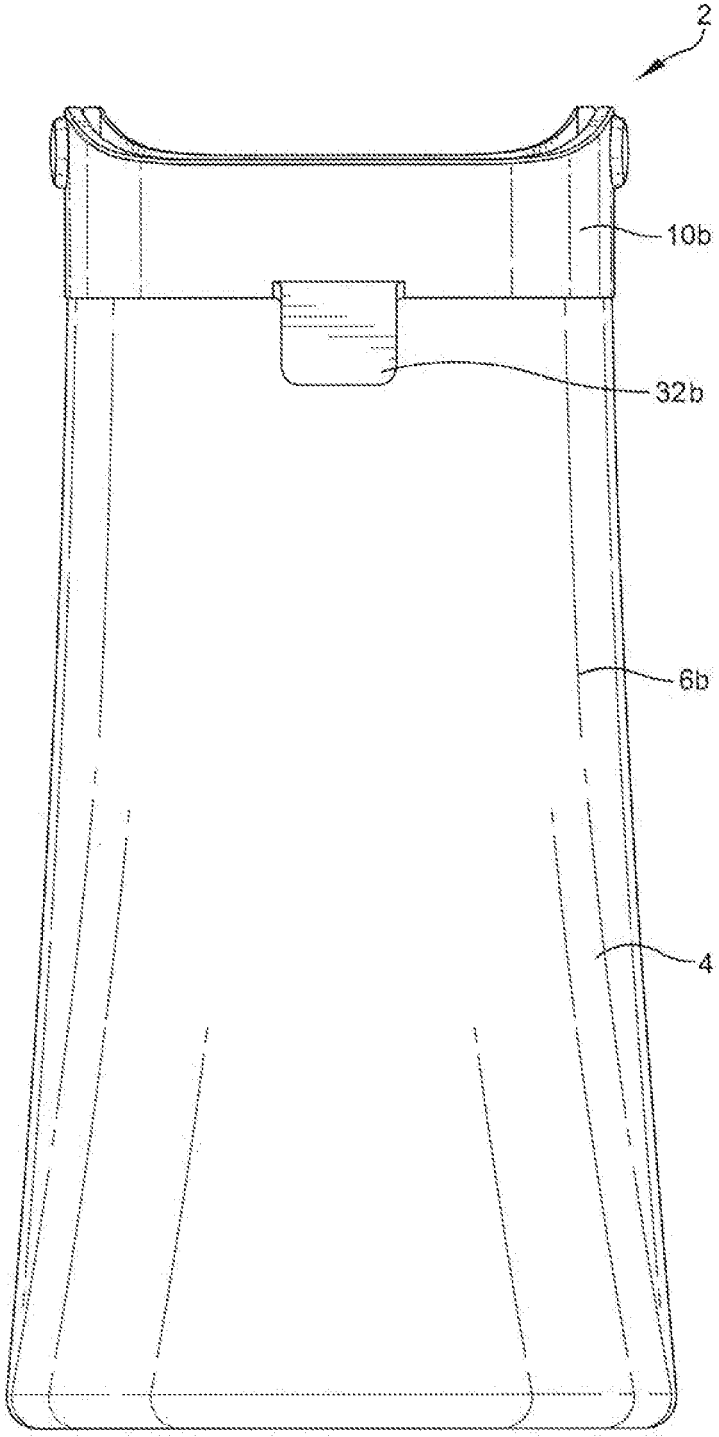
FIG. 2 is a front side view of the holder of FIG. 1, in accordance with some embodiments.
Figure 3:
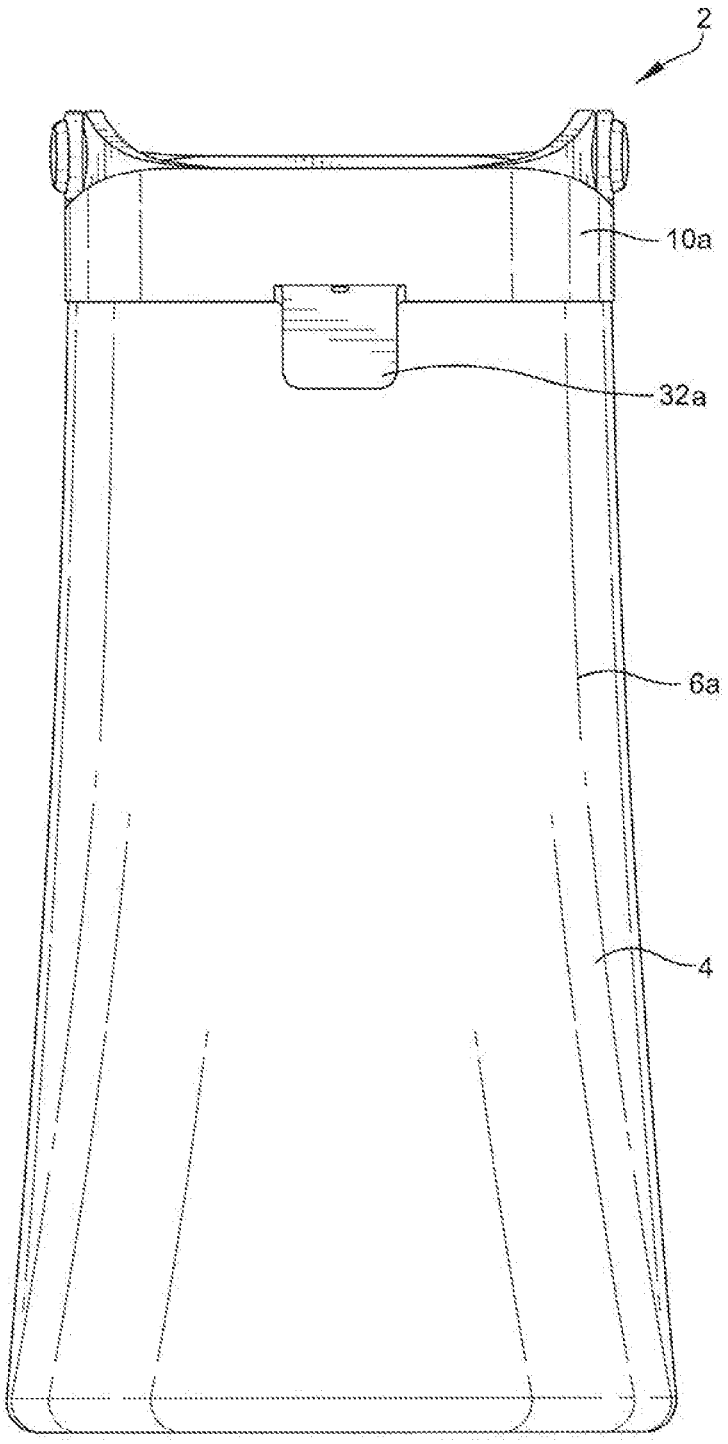
FIG. 3 is a rear side view of the holder of FIG. 1, in accordance with some embodiments.
Figure 4:
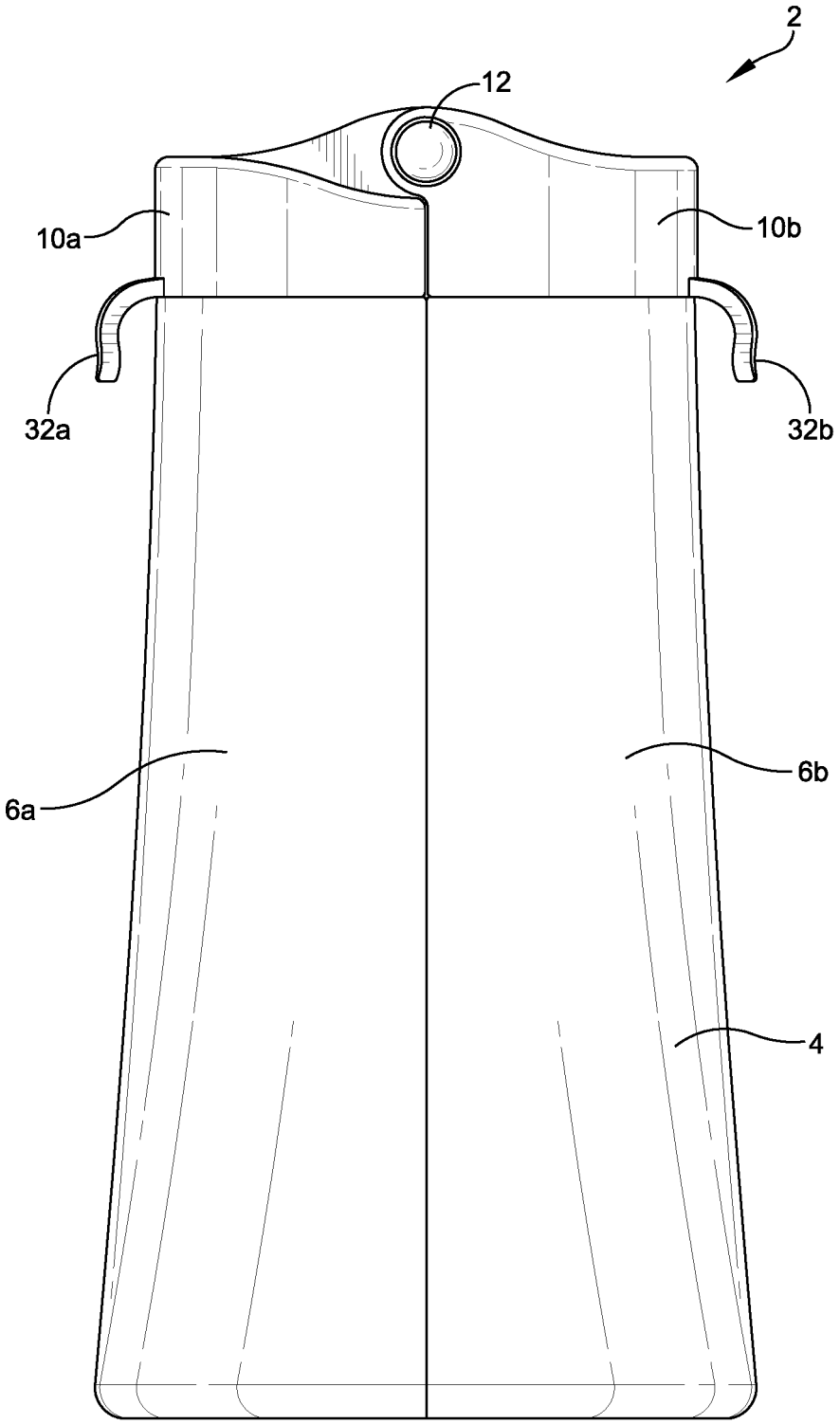
FIG. 4 is a side view of tool holder of FIG. 1, in accordance with some embodiments.
Figure 5:
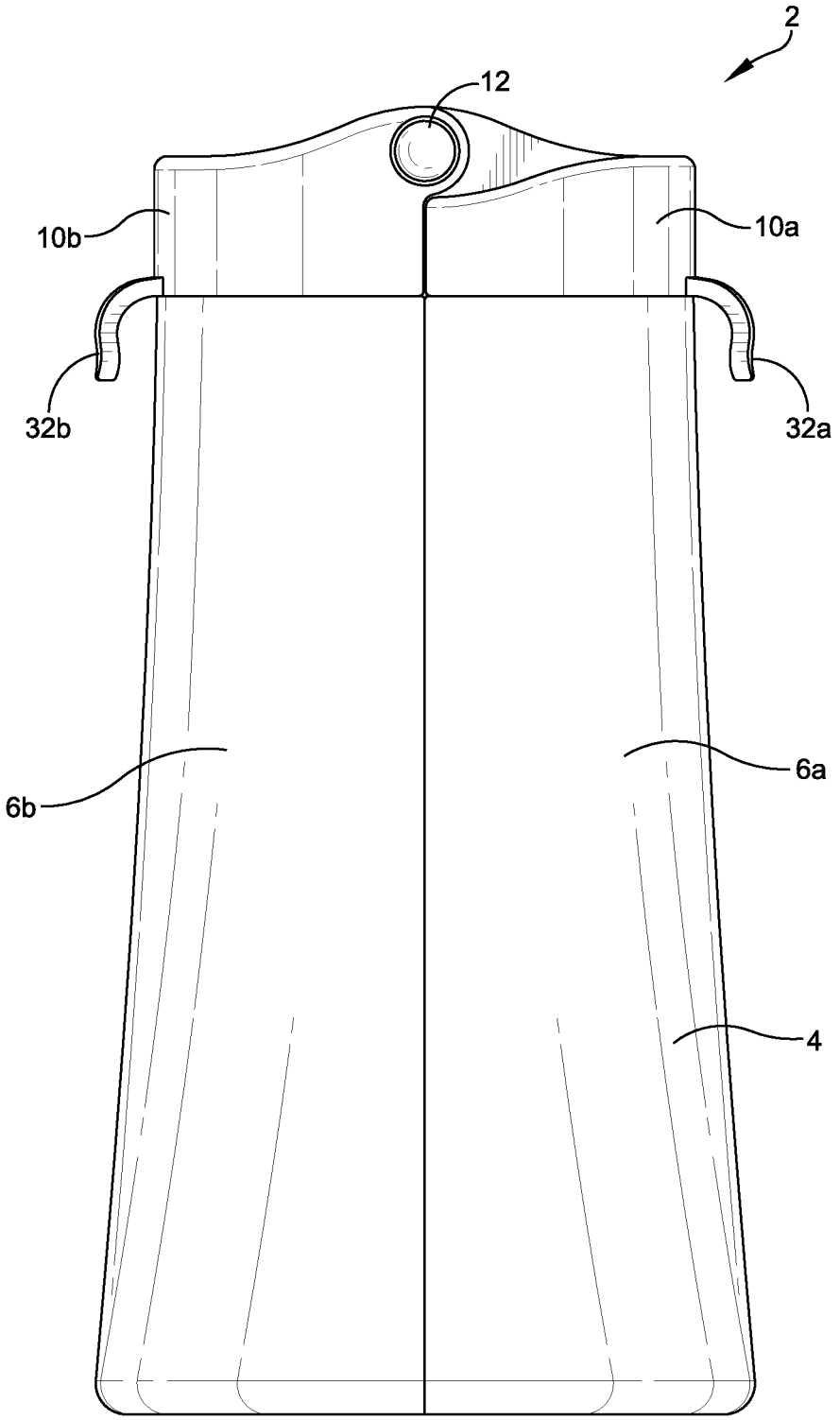
FIG. 5 is a side view opposite the view of FIG. 4 of the tool holder of FIG. 1, in accordance with some embodiments.

This description of the exemplary embodiments is intended to be read in connection with the accompanying drawings, which are to be considered part of the entire written description.

In various embodiments, the disclosed tool holder is configured to support and store one or more heatable tools or appliance, such as a heatable hair styling tool, prior to, during, and after heating of the heatable tool. The tool holder is configured to transition from a first configuration (or position) suitable for storing the heatable tool to a second configuration (or position) suitable for supporting the heatable tool during use. In some embodiments, the tool holder includes a body defined by a first half rotatably coupled to a second half in a clam-shell configuration. The first half and the second half are rotatable about an axis of rotation from a first facing relationship (first configuration) to a second end-to-end relationship (second configuration).

FIGS. 1-8 illustrate a tool holder 2 configured to storage and support of a heatable tool, in accordance with some embodiments. The tool holder 2 includes a body 4 defined by a first half 6*a* and a second half 6*b*. Each of the first half 6*a* and the second half 6*b* extend from a first (or top) edge 8*a* to a second (or bottom) edge 8*b* of the body 4. In some embodiments, each of the body halves 6*a*, 6*b* are flared such that the body 4 extends from a first diameter at the first edge 8*a* to a second, greater diameter at the second edge 8*b*. Each of the body halves 6*a*, 6*b* can have a partial geometric shape.

For example, in the illustrated embodiment, each of the body halves 6*a*, 6*b* have a half-rectangle shape including rounded corners, although it will be appreciate that each of the body halves 6*a*, 6*b* can include any suitable shape, such as a half-bell shape, a half-cylinder shape, a half-square shape, a half-pyramid shape, and/or any other suitable shape.

Each of the first half 6*a* and the second half 6*b* include an outer surface 46 and an inner surface 48. In some embodiments, the first half 6*a* and the second half 6*b* of the body are positioned in a clam-shell arrangement. In a first configuration, the first half 6*a* and the second half 6*b* are positioned in a facing, abutting relationship such that the inner surface 48 of the first half 6*a* and the inner surface 48 of the second half 6*b* define a tool cavity 20 therebetween, The tool cavity 20 is sized and configured to receive at least a portion of a heatable tool or appliance therein. In some embodiments, each of the first half 6*a* and the second half 6*b* include a proximal lip 10*a*, 10*b* at a proximal edge 8*a*.

In some embodiments, the first half 6*a* is rotatably coupled to the second half 6*b* by a rotation element 12. The rotation element 12 can be positioned at a proximal end 4*a* of the body 4. The rotation element 12 can include any suitable rotation element. For example, in the illustrated embodiment, the rotation element 12 includes a hinge 12 having at least one first hinge element coupled to a proximal end 4*a* of the first half 6*a* of the body 4 and at least one second hinge element coupled to the proximal end 4*a* of the second half of the body 4. The hinge elements can be coupled to and/or formed integrally with the proximal end 4*a* of the respective first and second halves 6*a*, 6*b*.

Figure 8:
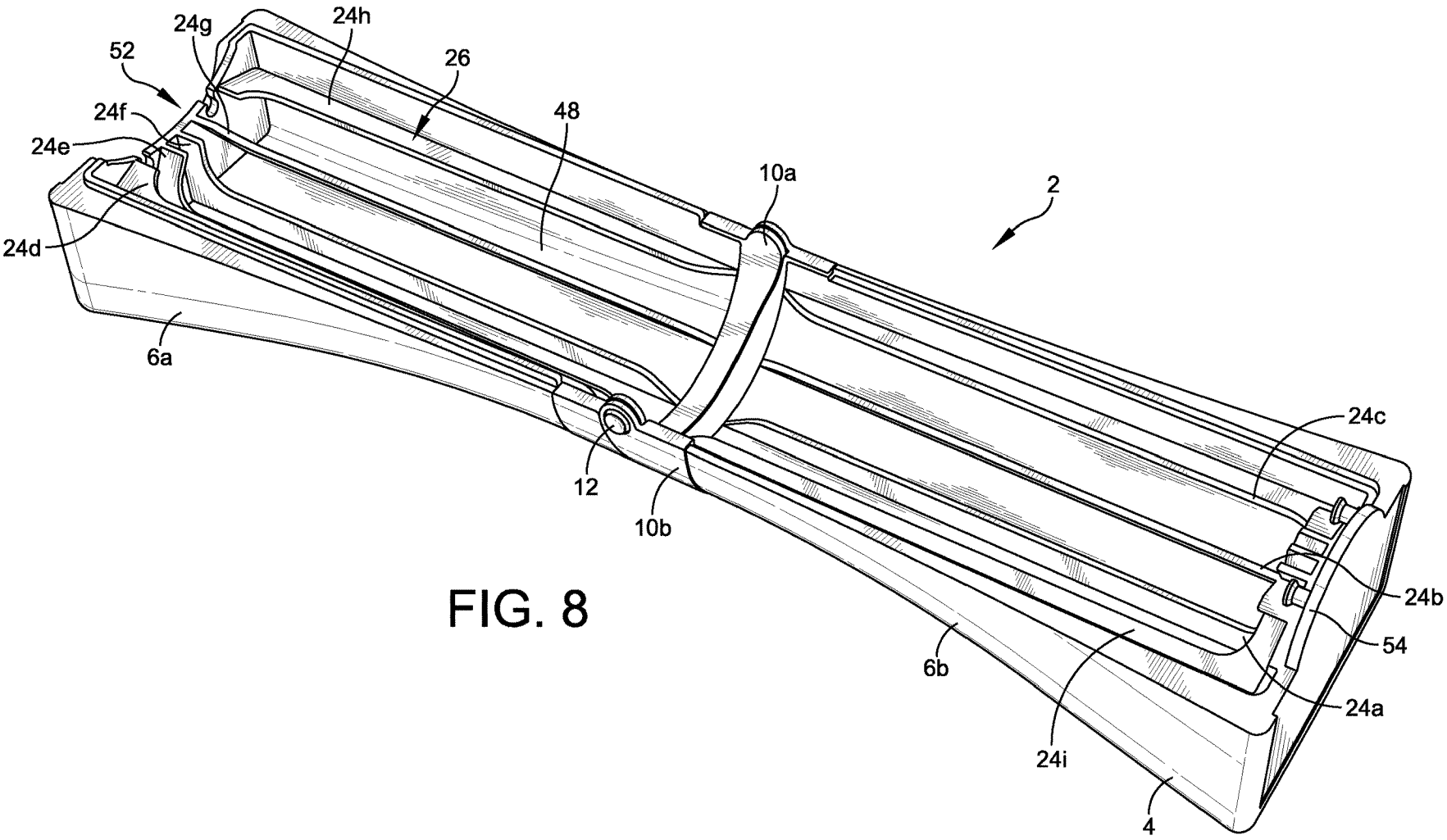
FIG. 8 is a side elevation view of the tool holder of FIG. 1 in an open position, in accordance with some embodiments.

In some embodiments, the first hinge element 12*a* defines a hole 16 extending through a portion of first half 6*a* and the second hinge element 12*b* defines at least one hinge pin 18 extending from the outer surface 46 of the second half 6*b*. The hole 16 is sized and configured to receive the hinge pin 18 at least partially therethrough. The hole 16 and the hinge pin 18 couple the first half 6*a* and the second half 6*b* in a rotatable relationship. The rotation element 12 (for example, the holes 16 and the hinge pins 18) define an axis of rotation. The first half 6*a* and the second half 6*b* are configured to be rotated from a first position (as shown in FIG. 1) to a second position (as shown in FIG. 8) about the axis of rotation.

Figure 6:
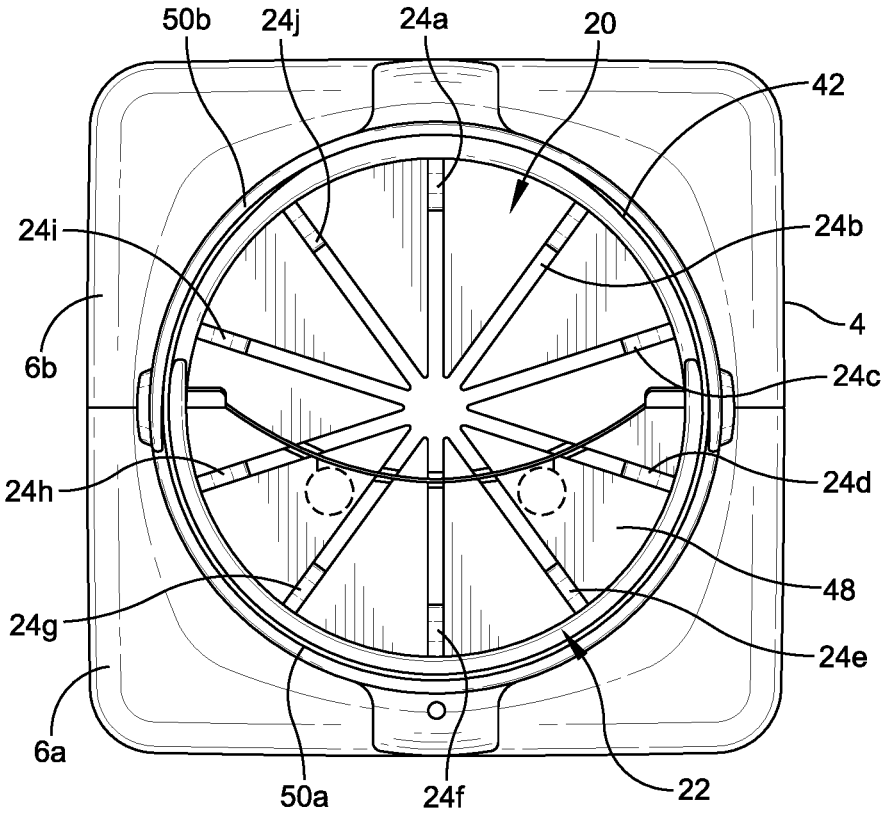
FIG. 6 is a top side view of the tool holder of FIG. 1, in accordance with some embodiments.
Figure 9:
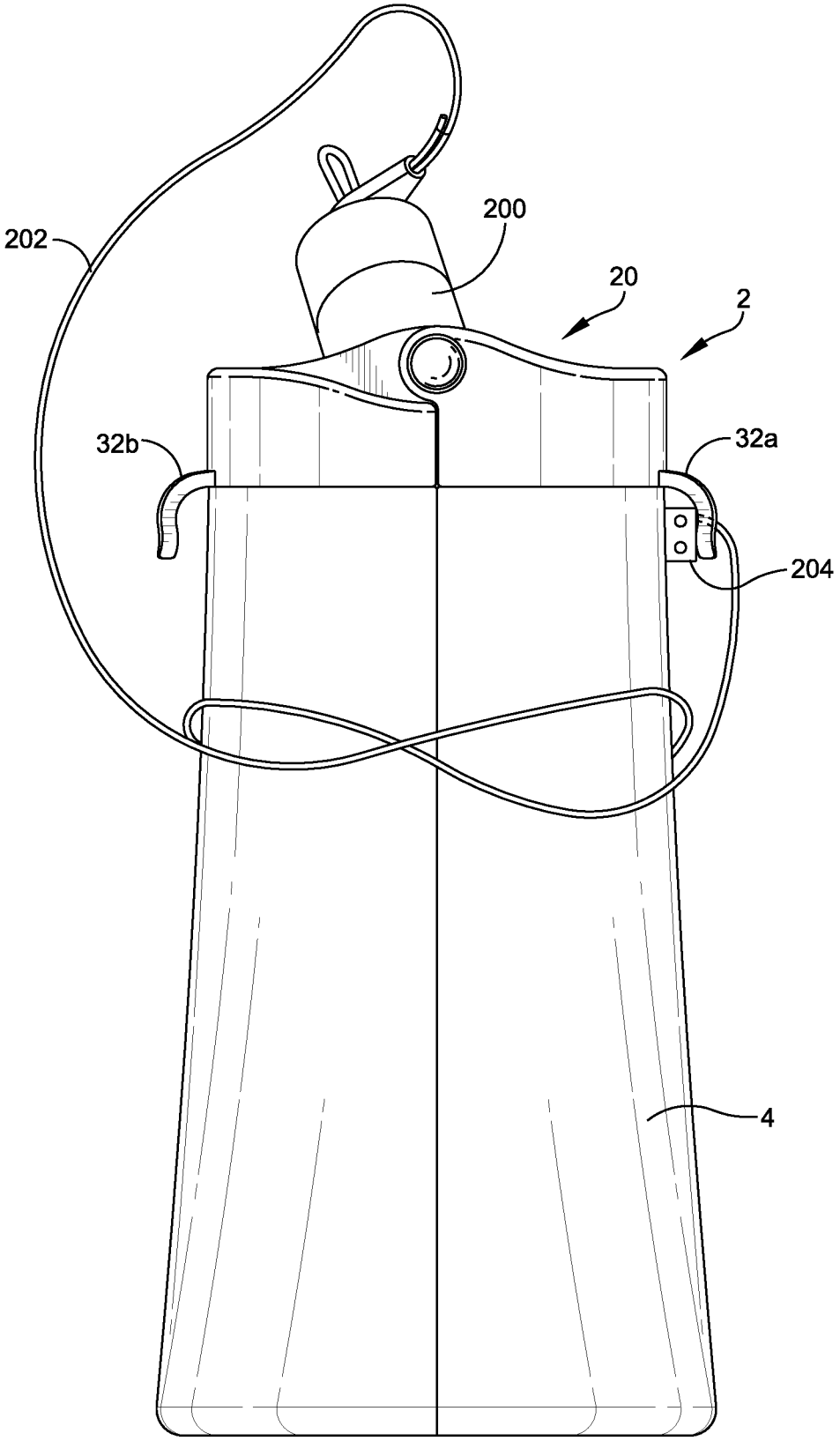
FIG. 9 illustrates the tool holder of FIG. 1 in a closed position and having a heatable tool inserted therein, in accordance with some embodiments.

As shown in FIG. 6, the proximal surface 42 of the first half 6*a* and the second half 6*b* each define a cutout 50*a*, 50*b*. When the tool holder 2 is in the first configuration, the cutouts 50*a*, 50*b* define a tool opening 22 at a proximal end 4*a* of the body 4. The tool opening 20 is sized and configured to receive one or more heatable tools and/or appliances therethrough. For example, as shown in FIG. 9, in some embodiments, the tool opening 22 is sized and configured to receive a heatable tool 200 such as a curling iron, a flat iron, a spiral iron, a heated brush, and/or any other heatable tool therethrough. In some embodiments, the cutouts 50*a*, 50*b*, and by extension the tool opening 22, can have any suitable shape for receiving a heatable tool. For example, as shown in FIG. 6, each of the cutouts 50*a*, 50*b* are half-circles such that the tool opening 22 is a circular opening, although it will be appreciated that the cutouts 50*a*, 50*b* and/or the tool opening 22 can have a square shape, an oblong shape, an oval shape, and/or any other suitable shape.

The tool opening 22 extends through the proximal end 4*a* of the body 4 into the tool cavity 20 defined by the first and second halves 6*a*, 6*b* of the body 4. As discussed above, the tool cavity 20 is sized and configured to receive a working portion of a heatable tool therein. In some embodiments, the tool cavity 20 has a diameter greater than a diameter of the working portion of the heatable tool such that the heatable tool does not contact an inner surface 48 of the body 4 when the heatable tool is inserted into the tool cavity 20. The tool cavity 20 is configured to allow heat to dissipate from the heatable tool while inserted within the tool cavity 20.

In some embodiments, one or more spines 24*a*-24*j* extend from the inner surface 48 of the body 4 into the tool cavity 22. The spines 24*a*-24*j* are sized and configured to support a working portion of a heatable tool when the heatable tool is inserted into the tool cavity 22. In some embodiments, the spines 24*a*-24*j* have a predetermined height sufficient to create an air gap between a portion of the heatable appliance and an inner surface 48 of the body 4. The air gap between the inner surface 48 and the heatable tool limits heating of the body 4 and allows dissipation of heat from the heatable tool. In some embodiments, the spines 24*a*-24*j* function as heat sinks and further dissipate and/or absorb heat from the heatable tool to limit heating of the body 4.

Figure 10:
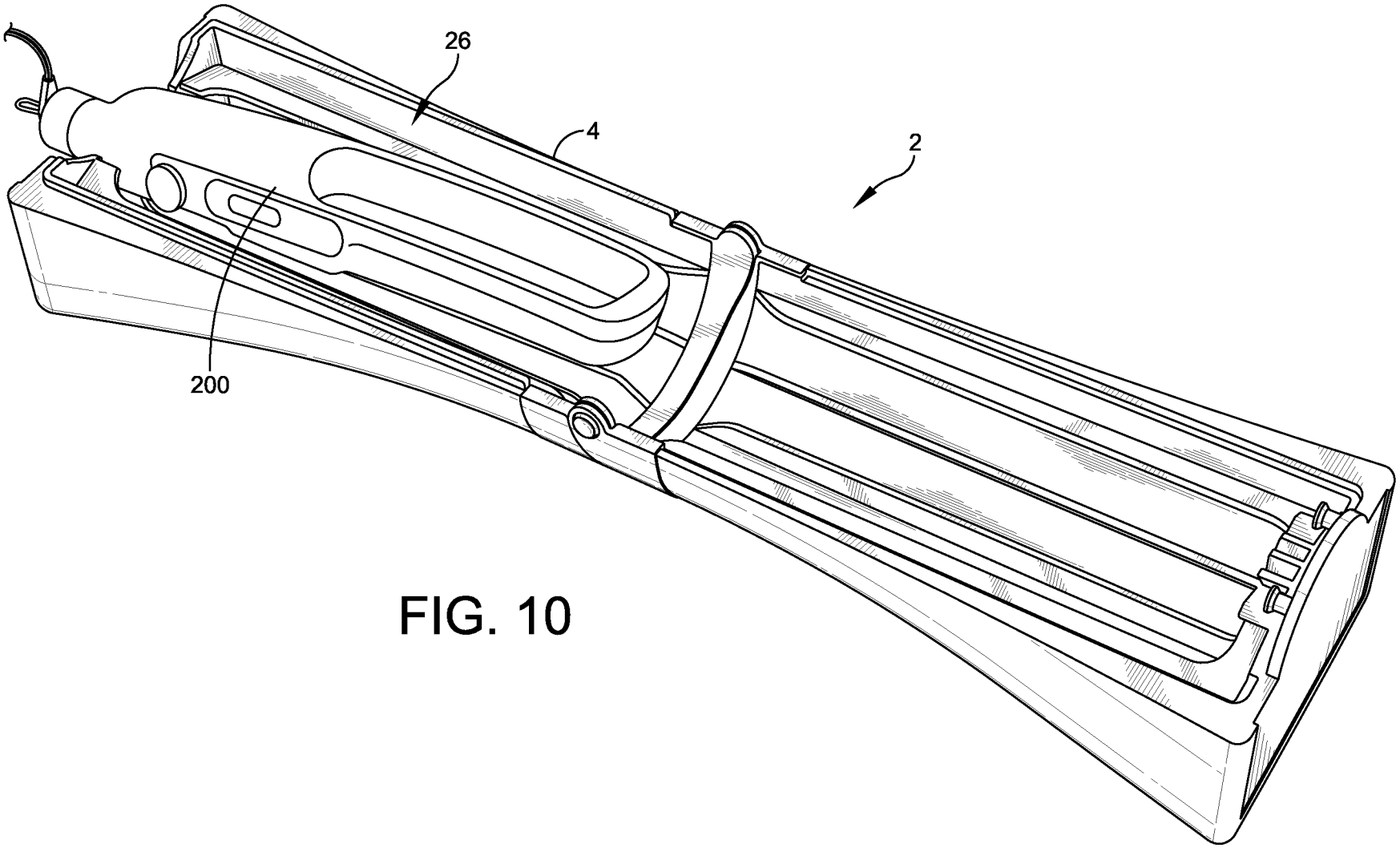
FIG. 10 illustrates the tool holder of FIG. 1 in an open position and having a heatable tool support thereon, in accordance with some embodiments.

FIG. 8 illustrates the tool holder 2 of FIG. 1 in a second (or open) configuration. The body 4 is transitioned from the first configuration to the second configuration by rotating the first half 6*a* and/or the second half 6*b* about the axis of rotation defined by the rotation element 12. The rotation element 12 allows the first half 6*a* to rotate about 180° with respect to the second half 6*b* of the body 4. The first half 6*a* is positioned in a longitudinally-aligned, end-to-end relationship with the second half 6*b* in the second configuration. The inner surface 48 of the first half 6*a* and/or the second half define a tool resting area 26. The tool resting area 26 is sized and configured to allow a heatable tool to be rested on the tool holder 2. The tool holder 2 insulates a surface beneath the body 4 from the heat generated by the heatable tool during use. FIG. 10 illustrates the tool holder 2 having a heatable tool 200 positioned in the tool resting area 26, in accordance with some embodiments.

In some embodiments, one or more supports 32*a*, 32*b* extend from an outer surface 46 of the body 4. For example, in the illustrated embodiment, a first support 32*a* extends from an outer surface 46 the first half 6*a* of the body 4 and a second support 32*b* extends from an outer surface 46 of the second half 6*b* of the body 4. The supports 32*a*, 32*b* extend a predetermined distance from an outer surface of the body 4. In some embodiments, the supports 32*a*, 32*b* include an extension portion 34 extending at an angle from an outer surface 46 of the body 4 and a support portion 36 extending at an angle from the end of the extension portion 34. In the illustrated embodiment, the extension portion 34 extends substantially perpendicular (i.e., at about 90°) from the outer surface 46 and the support portion 36 extends substantially perpendicular to the extension portion 34.

The first support 32*a* and the second support 32*b* are configured to support a portion of the body 4 when the body 4 is positioned in the second configuration. For example, in the illustrated embodiment, the first and second supports 32*a*, 32*b* extend a predetermined distance from the outer surface of the body 4 such that the support portion 36 of the first and second supports 32*a*, 32*b* is positioned within the same plane as the proximal edge of the body 4, although it will be appreciated that the first and second supports 32*a*, 32*b* can positioned at a greater and/or lesser distance from the outer surface of the body 4.

As shown in FIG. 9, in some embodiments, the first support 32*a* and/or the second support 32*b* are configured to support a portion of a cord 202 and/or plug 204 extending from the heatable tool 200 when the body 4 is positioned in the first configuration. For example, in some embodiments, a cord 202 extending from a distal end of the heatable tool 200 can be wrapped about the body 4 finishing with a plug 204 or a cord 202 being retained by the first support 32*a* and/or the second support 32*b* to maintain the cord 202 in a fixed position. As another example, in some embodiments, a plug 204 coupled to a distal end of the cord 202 can be frictionally maintained between one of the first support 32*a* or the second support 32*b* and the body 4.

Figure 7:
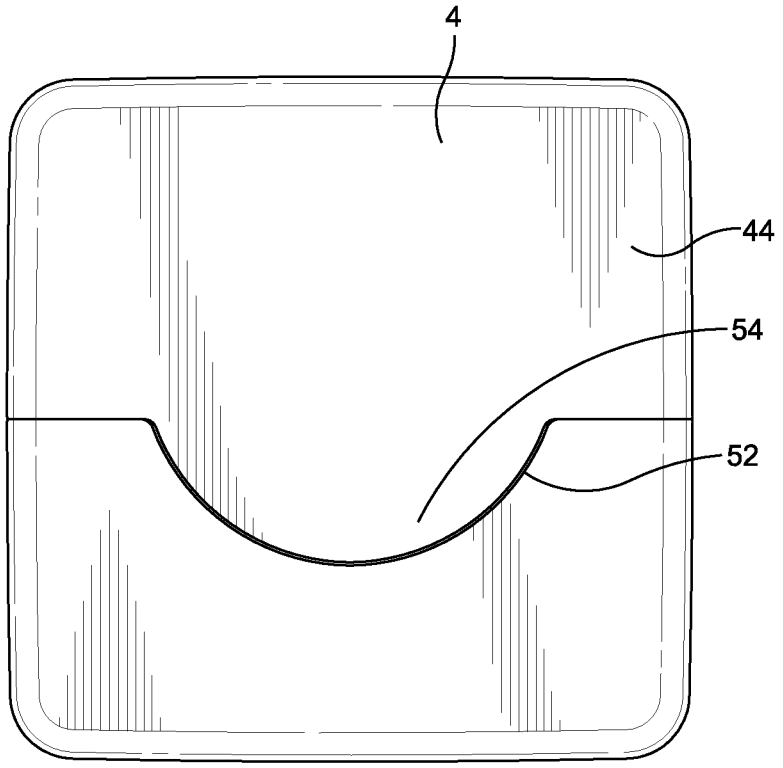
FIG. 7 is a bottom side view of the tool holder of FIG. 1, in accordance with some embodiments.

In some embodiments, as shown in FIG. 7, a portion of the distal end 4*b* of the first half 6*a* of the body 4 defines a cutout 52 sized and configured to receive a portion of a heatable tool therein. The cutout 52 is configured to maintain the heatable tool within a predetermined position in the tool support area 26. For example, in the illustrated embodiment, the cutout 52 is configured to center a heatable tool on a center axis of the tool support area 26. In embodiments including a cutout 52, the second half 6*b* of the body 4 defines an extension 54 sized and configured to fit within the cutout 52 such that the distal surface 44 of the body 4 defines a solid surface when the first half 6*a* and the second half 6*b* are positioned in the first (closed) position.

Figure 11:
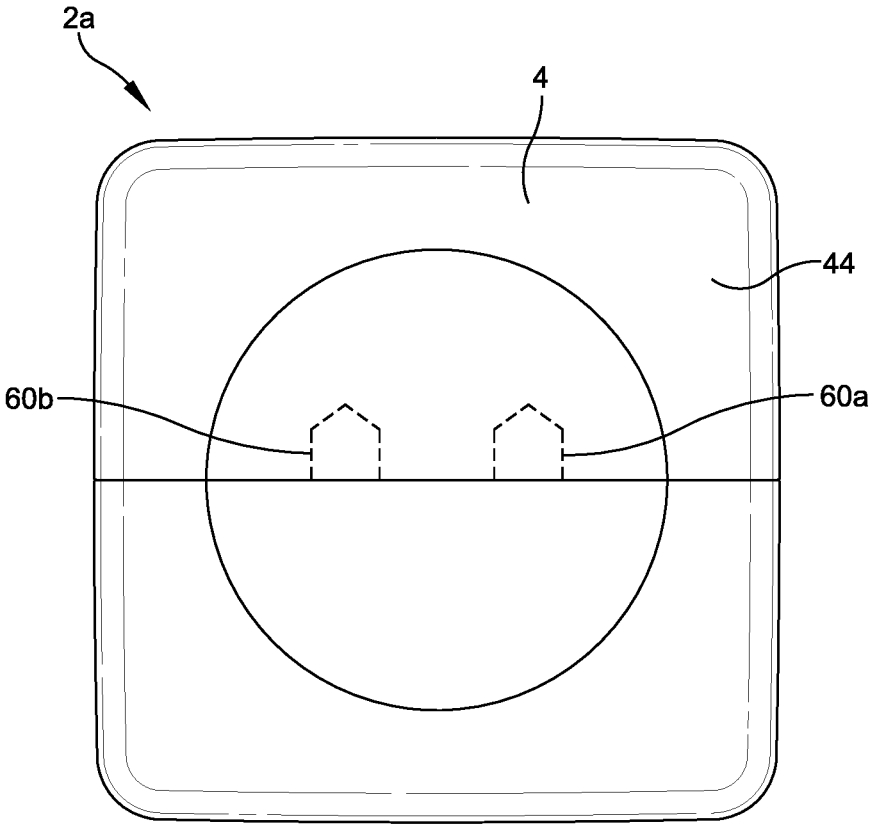
FIG. 11 illustrates an alternative bottom view of the tool holder of FIG. 1, in accordance with some embodiments.
Figure 13:
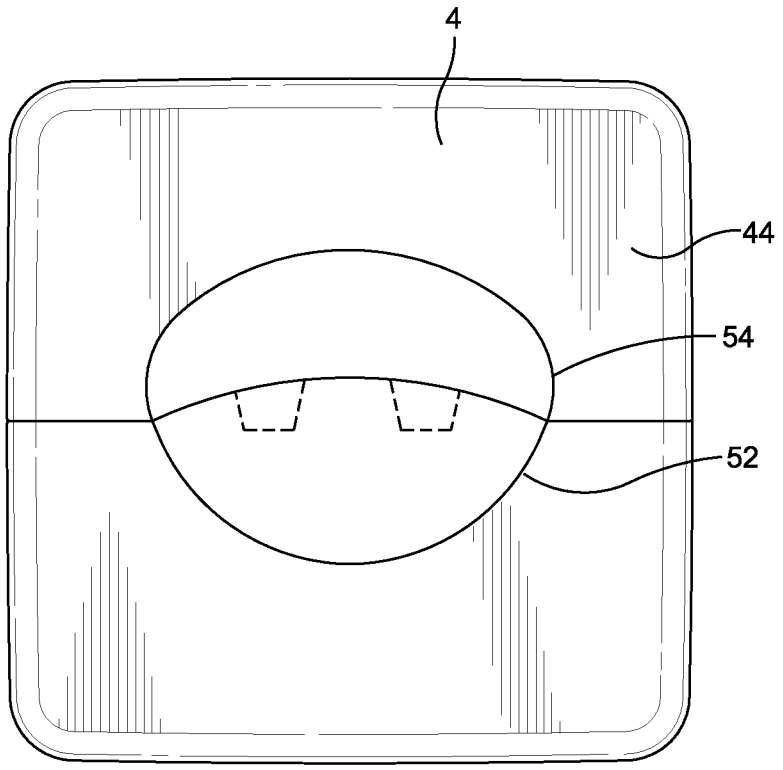
FIG. 13 illustrates an alternative bottom view of the tool holder of FIG. 1, in accordance with some embodiments.

In some embodiments, the cutout 52 defined by the distal end 4*b* of first half 6*a* of the tool holder 2*a* can include any suitable shape, such as a saw-tooth shape. As shown in FIGS. 11 and 13, the first half 6*a* and the second half 6*b* can define one or more interlocking teeth 60*a*-60*b*. The interlocking teeth 60*a*-60*b* provide a friction fit such that the distal end 4*b* of the body defines a solid surface when the first half 6*a* and the second half 6*b* are positioned in the first (closed) position. The interlocking teeth 60*a*-60*b* can be configured to provide frictional resistance to rotation of the body 4 from the first position to the second position such that a minimum force must be applied to overcome the frictional resistance of the interlocking teeth 60*a*-60*b* before the body 4 can be rotated. In some embodiments, the interlocking teeth 60*a*-60*b* are hidden (i.e., positioned within the body 4) when the body is in the first position.

In some embodiments, one or more of the body 4, the spines 24*a*-24*j*, and/or any other portion of the tool holder 2 includes an insulating material configured to prevent and/or limit transmission of heat from a heated appliance to an outer surface of the body 4. For example, in various embodiments, one or more of the body 4, the spines 24*a*-24*j*, and/or any other portion of the tool holder 2 includes a silicone material, although it will be appreciated that any suitable insulating material can be used. In some embodiments, the proximal lip 10*a*, 10*b* can include a separate and/or additional material as the body 4.

In some embodiments, each of the first half 6*a* and the second half 6*b* of the body 4 have a predetermined length sufficient to fully support a working portion of a heatable tool 200. As shown in FIG. 10, the heatable tool 200 can be positioned within a tool support area 26 defined by a first half 6*a* of the body without contacting the proximal edge 8*a* and/or the second half 6*b* of the body 4. The heatable tool 200 can be removed from the tool support area 26 and the body 4 transitioned from the second position to the first position. After transitioning the body 4, the heatable tool 200 can be stored within the body 4 (see FIG. 9), for example, by inserting the heatable tool 200 through the tool opening 20 defined by the body 4 in the first position.

In some embodiments, the hair styling tool holder 2 can include one or more locking features configured to maintain the hair styling tool holder 2 in the first position and/or the second position. For example, in some embodiments, one or more hooks, latches, and/or other locking elements can be coupled to an outer surface 46 of the body 4. The locking elements can be configured to lock the body in one of the first configuration or the second configuration.

Figure 12:
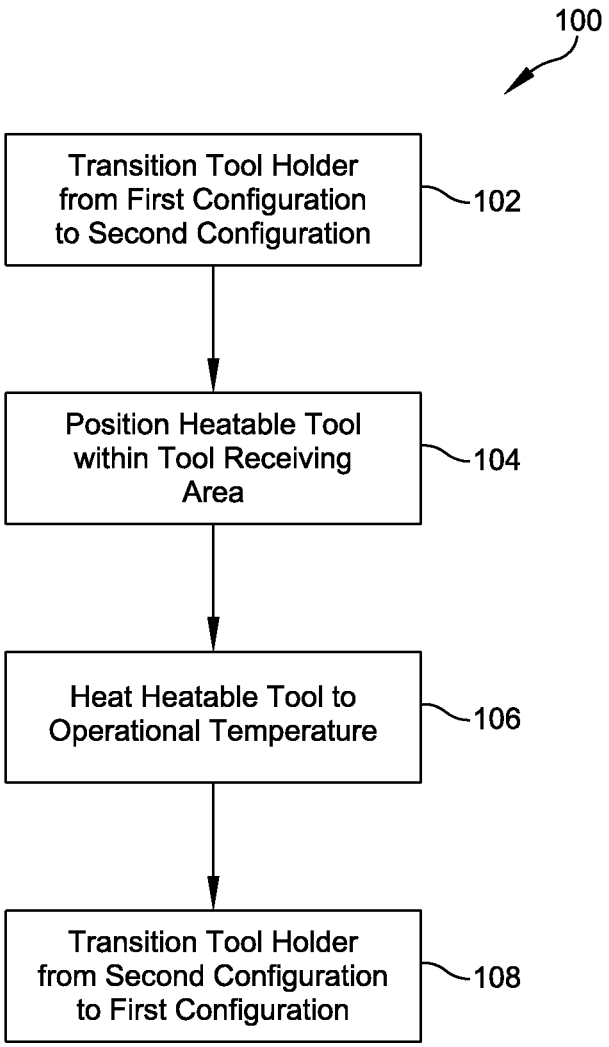
FIG. 12 is a flow chart illustrating a method of supporting and storing a heatable tool, in accordance with some embodiments.

FIG. 12 is a flow chart illustrating a method 100 of support and storing a heatable appliance using the tool holder 2, in accordance with some embodiments. In step 102, the tool holder 2 is transitioned from a first (or closed) position to a second (or open) position and placed on a surface. The tool holder 2 can be transitioned by applying a rotational force to one of the first half 6*a* and/or the second half 6*b*. In some embodiments, a locking device is engaged to maintain the hair styling tool holder 2 in the second position.

At step 104, a heatable tool or appliance is positioned within a tool receiving area 26 defined by the first half 6*a* of the body 4. The heatable tool can be supported by one or more spines 24*a*-24*i* extending from an inner surface 48 of the body 4 such that the heatable tool is maintained in a spaced arrangement with the body 4.

At step 106, the heatable tool is heated to an operational temperature. The spines 24*a*-24*i* and/or the body 4 include a material configured to insulate the surface beneath the hair styling tool holder 2 from the heated tool. For example, in some embodiments, the spines 24*a*-24*i* and/or the body 4 include a silicone material, although it will be appreciated that any other suitable insulating material can be used.

At step 108, the tool holder 2 is transitioned from the second position to the first position. The tool holder 2 can be transitioned by applying a rotational force to a portion of the first and/or second half 6*a*, 6*b* of the body 4. For example, in some embodiments, the heatable tool 200 is removed from the tool receiving area 26 def and the second half 6*b* of the body can be rotated about a rotation element 12 from the second (or open position) to the first (or closed position. The heatable tool 200 can be inserted into the closed body 4 and positioned within a tool cavity 20 defined by the first half 6*a* and the second half 6*b* when the tool holder 2 is closed.

Although the apparatus and method have been described in terms of exemplary embodiments, they are not limited thereto. Rather, the appended claims should be construed broadly, to include other variants and embodiments of the apparatus and method, which may be made by those skilled in the art without departing from the scope and range of equivalents of the apparatus and method.

What is claimed is:

1. A tool holder, comprising:

a body including a first half and a second half; and a rotation element coupling the first half of the body to the second half of the body, wherein the first half of the body and the second half of the body are rotatable about an axis of rotation defined by the rotation element from a first configuration to a second configuration, wherein in the first configuration the first half of the body and the second half of the body are in a facing relationship and define a cavity therebetween, and wherein in the second configuration the first half of the body and the second half of the body are in an end-to-end abutting relationship and aligned on a longitudinal axis such that the first half of the body and the second half of the body define a continuous tool surface;

a plurality of spines extending from an inner surface of the body at least partially into the cavity defined between the first half of the body and the second half of the body, wherein the plurality of spines have a predetermined height sufficient to create an air gap between the inner surface of the body and a tool positioned within the cavity, wherein each of the plurality of spines comprises a heat sink configured to absorb heat from the tool.

2. The tool holder of claim 1, wherein the rotation element comprises at least one hinge pin extending from a proximal end of the first half of the body and at least one opening formed in a proximal end of the second half of the body, wherein the at least one hinge pin is sized and configured for insertion through at least one opening.

3. The tool holder of claim 1, wherein the plurality of spines are configured to support a heatable appliance in a spaced relationship with the inner surface of the body.

4. The tool holder of claim 1, wherein the body has a first circumference at a proximal end and a second circumference at a distal end.

5. The tool holder of claim 4, wherein the second circumference is greater than the first circumference.

6. The tool holder of claim 4, comprising a first support coupled to the proximal end of the body, wherein the first support is configured to support a portion of the body in the second configuration.

7. The tool holder of claim 6, wherein the first support comprises an extension portion extending at a first predetermined angle from an outer surface of the body and a support portion extending and a second predetermined angle from the extension portion.

8. The tool holder of claim 7, wherein the first predetermined angle is 90° and the second predetermined angle is 90°.

9. The tool holder of claim 1, wherein the body comprises silicone.

10. The tool holder of claim 1, wherein a distal portion of the first half of the body defines a cutout sized and configured to receive a handle of a heated appliance therein and the second half of the body defines an extension sized and configured to be received within the cutout.

11. A heatable tool holder, comprising:

a body having a first half and a second half each extending from a proximal end to a distal end, wherein the first half is rotatably coupled to the second half at the proximal end, and wherein the body is configured to be transitioned from a first configuration having the first half and the second half in a facing relationship defining a cavity therebetween and an opening extending through the proximal end to the cavity to a second configuration having the first half and the second half in an abutting relationship and aligned on a longitudinal axis such that the first half of the body and the second half of the body define a continuous tool surface; and a plurality of spines extending from an inner surface of the body at least partially into the cavity, wherein the plurality of spines are sized and configured to support a portion of a heatable tool inserted into the cavity in a spaced relationship with the inner surface of the body to create an air gap between the inner surface and the heatable tool, and wherein each of the plurality of spines comprises a heat sink configured to absorb heat from the heatable tool.

12. The heatable tool holder of claim 11, comprising at least one hinge pin extending from a proximal end of the first half and at least one opening formed in a proximal end of the second half, wherein at least one hinge pin is sized and configured for insertion through at least one opening, and wherein at least one hinge pin rotatably couples the first half to the second half.

13. The heatable tool holder of claim 11, wherein the body has a first circumference at a proximal end and a second circumference at a distal end.

14. The heatable tool holder of claim 13, wherein the second circumference is greater than the first circumference.

15. The heatable tool holder of claim 13, comprising a first support coupled to the proximal end of the body, wherein the first support is configured to support a portion of the body in the second configuration.

16. The heatable tool holder of claim 11, wherein the body comprises silicone.

17. The heatable tool holder of claim 11, wherein a distal portion of the first half defines a cutout sized and configured to receive a handle of a heated appliance therein and the second half defines an extension sized and configured to be received within the cutout.

18. A method of supporting and storing a heatable tool, comprising:

positioning a heatable tool holder in a first position, wherein the heatable tool holder includes a body having a first half rotatably coupled to a second half, wherein in the first position the first half of the body and the second half of the body are positioned in an abutting relationship and aligned on a longitudinal axis such that the first half of the body and the second half of the body define a continuous tool surface, wherein the first half of the body includes a plurality of spines extending from an inner surface of thereof;

positioning a heatable tool on the first half of the body, wherein the plurality of spines are sized and configured to support the heatable tool inserted into the cavity in a spaced relationship with the inner surface of the body to create an air gap between the inner surface and the heatable tool, and wherein each of the plurality of spines comprises a heat sink configured to absorb heat from the heatable tool; and transitioning the heatable tool holder from the first position to a second position, wherein in the second position the first half and the second half are in a facing relationship and define an appliance cavity therebetween, and wherein the heatable tool is positioned within the appliance cavity.

19. The method of claim 18, wherein the first half is rotatably coupled to the second half by a hinge.

20. The method of claim 18, wherein transitioning the heatable tool holder from the first position to the second position comprises rotating the second half of the body about an axis of rotation defined by the rotation element.

* * * * *